United States Patent [19]

Demetri

[11] Patent Number: 4,901,677

[45] Date of Patent: Feb. 20, 1990

[54] FINNED-TUBE HEAT EXCHANGER WITH LIQUID-COOLED BAFFLE

[75] Inventor: Elia P. Demetri, Woburn, Mass.

[73] Assignee: Gas Research Institute, Chicago, Ill.

[21] Appl. No.: 356,571

[22] Filed: May 22, 1989

Related U.S. Application Data

[63] Continuation of Ser. No. 287,460, Dec. 21, 1988, abandoned.

[51] Int. Cl.[4] ..... F22B 21/26; F28F 13/06

[52] U.S. Cl. ..... 122/235 F; 122/248; 122/250 R; 122/367 C; 122/DIG. 3; 165/102; 165/163; 165/159

[58] Field of Search ..... 165/172, 173, 163, 102, 165/159; 122/367 C, 367 R, 235 F, 248, 249, 250 R, 250 S, DIG. 3; 137/339

[56] References Cited

U.S. PATENT DOCUMENTS 1,691,934 11/1928 Packard .
1,825,666 10/1931 Jacobus .
1,972,100 9/1934 Lucke .
4,366,778 1/1983 Charrier et al. ..... 122/367 C
4,512,336 4/1985 Wiener ..... 165/172
4,719,969 1/1988 Patton et al. ..... 165/163

*Primary Examiner*—Albert W. Davis, Jr.
*Attorney, Agent, or Firm*—Hamilton, Brook, Smith & Reynolds

[57] ABSTRACT

A gas-to-liquid heat exchanger formed by winding circular finned tubing into a helical coil has bare tubing wrapped around the coil such that it nests between adjacent turns of the finned tubing. Fittings at the inlets and outlets of both coils distribute the liquid stream so that a portion flows through each coil. The fan tube coil acts as a cooled baffle which directs the hot gas stream flowing over the finned tubes so that it contacts a greater portion of the finned tube external surface area at high velocity and increases the heat transfer effectiveness. Because the baffle is cooled, its temperature remains close to that of the finned tubing. This protects the baffle and eliminates differential expansion which could cause the baffle to fall off or loosen during operation.

7 Claims, 1 Drawing Sheet

FINNED-TUBE HEAT EXCHANGER WITH LIQUID-COOLED BAFFLE

This is a continuation of co-pending application Ser. No. 07-287,460 filed on Dec. 21, 1988, now abandoned.

BACKGROUND OF THIS IVENTION

1. Field of This Invention

This invention is related to heat exchange means for transferring heat indirectly from a hot gas stream flowing across finned tubing to a cold liquid stream flowing through the tubing.

2. Description of the Prior Art

Heat exchangers for transferring heat between a liquid stream and gas stream are commonly fabricated using externally-finned tubing. An example is a gas-fired hydronic boiler. One approach for achieving a compact high-effectiveness configuration is to wrap the tubing in the form of a coil in which the liquid stream flows inside the tubes and the gas stream flows across the tubes and between adjacent rows of the coil.

An important problem with this type of configuration is that a significant fraction of the external surface area of the tubes is ineffective in transferring heat. This is because a high heat transfer coefficient on the hot-gas side of the heat exchanger is achieved only in the high-velocity region between adjacent rows of the coil through which the gas stream flows. A second problem is directly related to the difficulty in maintaining a uniform spacing between tubes in wrapping the coil. The resulting variation in gap size causes a nonuniform distribution of flow on the hot-gas side. This problem is especially acute when the fin height is small in comparison to the tube diameter. A nonuniform flow distribution is undesirable because it reduces the overall heat-transfer effectiveness achievable with a given coil geometry.

A method of alleviating these problems is to wrap a sheet metal strap around the coil between adjacent tube rows such that it contacts the fins of the adjacent rows. When wrapped in this manner the strap acts as a baffle forcing the hot-gas stream to flow at a high velocity over a greater portion of the tube surface thereby increasing the heat-transfer effectiveness. With the baffle, the gas is forced to flow through the space between the fins. Since the fin diameter and spacing are considerably more uniform than the gap between tube rows, the baffle also significantly reduces the degree of flow maldistribution.

BROAD DESCRIPTION OF THIS INVENTION

The use of a metal strap as the baffle has an important shortcoming. Because the strap is uncooled during operation, its temperature becomes significantly higher than the fins with which it is in contact. As a result of the differential thermal expansion, the strap pulls away from the tubes, thus opening gaps. The increased gas flow through the gaps and the decreased cooling due to loss of contact with the fins aggravates the problem by further increasing the local strap temperature. The strap can loosen to the extent that it permanently falls away from the tubes. It is also likely that the temperature gets high enough that the strap fails due to overheating. In any case, the strap no longer acts as a baffle and the heat-transfer effectiveness of the heat exchanger falls below the required design value.

An object of this invention is to provide a simple, reliable and inexpensive means of increasing the effectiveness of gas-to-liquid heat exchangers of the finned-tube variety. Another objective is to provide a means of preventing the effectiveness from decreasing with time. A further objective is to reduce the sensitivity of the effectiveness to tolerances in the fabrication of the finned-tube heat exchanger.

The objectives and advantages of this invention are achieved by the apparatus and process of this invention.

This invention involves a means for increasing the effectiveness of the heat transfer process on the gas side of finned-tube gas-to-liquid heat exchangers in which the hot gas flows across the tubes and through the space between adjacent rows of tubes while the liquid flows inside the tubes. The means to accomplish this includes the use of small-diameter unfinned tubing bridging the gap between adjacent rows of finned tubing and acting as a baffle to force the gas to flow at high velocity over a greater portion of the finned tube surface area. The unfinned tubing is connected to the liquid flow circuit of the heat exchanger such that a portion of the liquid stream flows through the tubing. This cools the unfinned-tubing baffle and insures that its temperature remains close to the finned tubing with which it is in contact. As a result there is little differential thermal expansion between the finned and unfinned tubing and less tendency to lose contact and eliminate the effect of the baffle in improving heat transfer effectiveness. In addition, the cooling of the baffle prevents the possibility of its failing due to overheating by the hot gas. Furthermore, the circular cross-sectional shape of the unfinned tubing makes it more convenient than alternative geometric shapes to form into a baffle that maintains contact with adjacent rows of circular finned tubing.

DESCRIPTION OF A PREFERRED EMBODIMENT

Figure 1A:
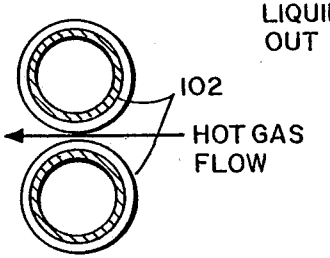
FIG. 1A is a cross-sectional view of two adjacent tube rows 102 of a finned-tube heat exchanger coil.
Figure 1B:
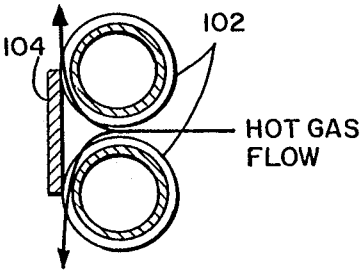
FIG. 1B is the same as FIG. 1A with a metal strap 104 wrapped around the coil to act as a baffle.

FIG. 1A illustrates an important problem in gas-to-liquid heat exchangers formed by coiling finned tubing 102. As indicated, the hot-gas stream tends to flow directly through the gap between tube rows. As a result, a large fraction of the external surface area of the finned tubes is ineffective in transferring heat because of the low gas velocity over this surface area. As shown in FIG. 1B, a practical method of alleviating this problem is to wrap a baffle 104 around the coil between adjacent tube rows 102. The baffle directs the hot gas stream so that it flows at high velocity over a greater portion of the external surface area resulting in a significant increase in heat transfer effectiveness.

Figure 2:
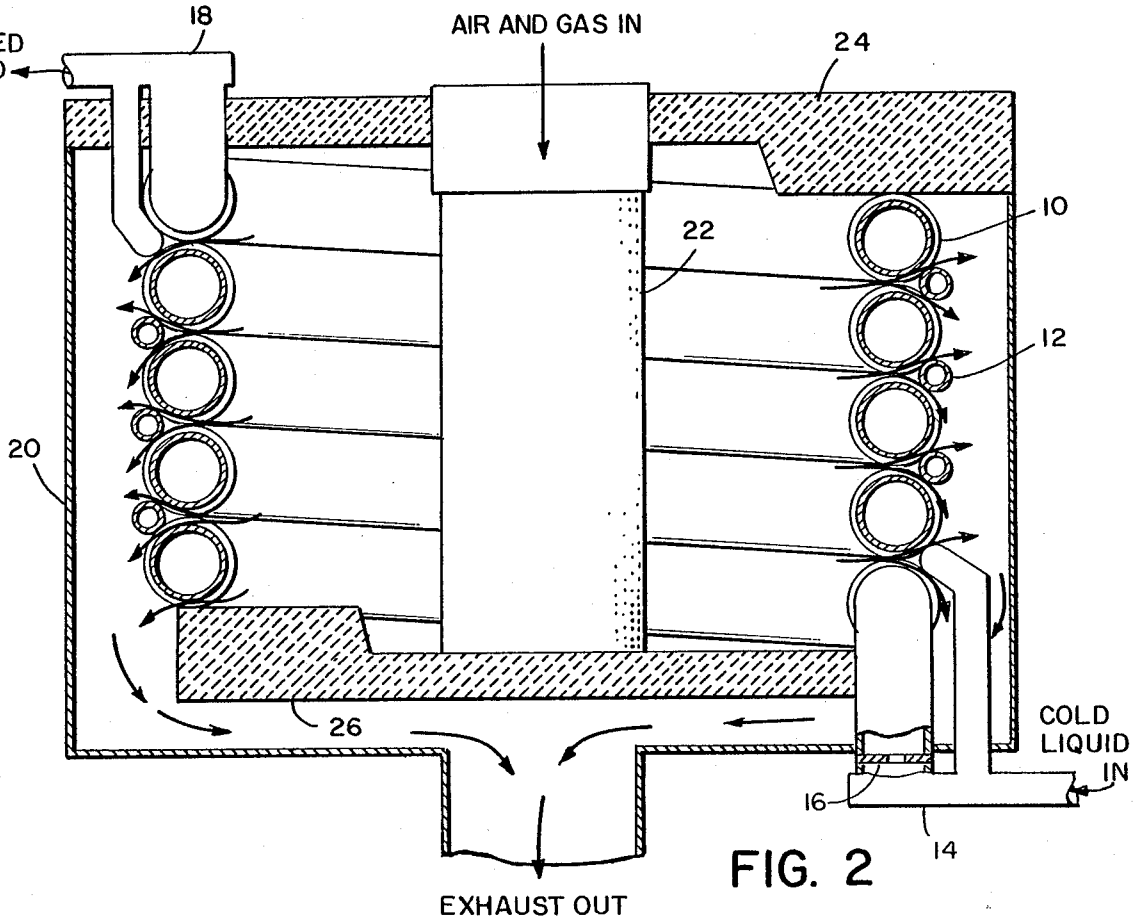
FIG. 2 is a cross sectional view of a monotube finned-tube heat exchanger embodying the present invention.

A finned-tube gas-to-liquid heat exchanger consisting of a gas-fired hydronic boiler embodying the present invention is shown in FIG. 2. The liquid heating coil 10 comprises finned tubing wound in a helical coil, such that the fin tips of adjacent turns are touching or nearly touching. Unfinned tubing 12 is wrapped around the finned-tube coil 10 such that it nests tightly in the span between adjacent turns and contacts the fin tips of the adjacent turns. The liquid to be heated enters through an inlet manifold 14 and flows through both the finned tube coil 10 and the unfinned coil 12. The orifice 16 is sized to provide a balancing flow resistance to proportion the incoming liquid flow between the two coils so that equal temperature rise occurs in each of the two parallel paths. The two streams of heated liquid join in the outlet manifold 18. The finned-tube coil 10 and unfinned-tube coil 12 are contained within a housing 20 which is constructed of heat resistant material. A burner 22 is mounted in an upper opening of the housing 20 to receive air and gas mixture from a combustion blower (not shown in FIG. 2). Burner 22 preferably consists of a perforated sheetmetal flameholder. the coil 10 is enclosed by the upper refractory insulation cap 24 and the lower insulating baffle 28. In operation, air and gas supplied by the combustion blower enter burner flameholder 22 and burn in the space between flameholder 22 and coil 10. The hot products of combustion flow in between the fins of coil 10. The unfinned coil 12 acts as a baffle forcing the hot-gas stream to flow at a high velocity over a greater portion of the surface of the finned tube coil 10 thereby increasing the heat transfer effectiveness. Since the unfinned tube coil 12 is cooled by the liquid flowing through it, its temperature remains close to that of the finned tubing during operation. As a result, there is little if any differential thermal expansion and the baffle remains in contact with the finned-tube coil. An additional advantage is that the circular shape of the finned tubing makes it easier to nest tightly between coil rows and improves its effectiveness as a baffle in increasing the average gas-side heat transfer coefficient. Another advantage is that the unfinned-tubing coil 12 provides additional heat transfer area which further increases the effectiveness of the heat exchanger. The application of this invention will increase the achievable heat-transfer effectiveness of finned-tube heat exchanger coils and will help insure that the effectiveness does not deteriorate over the life of the system.

The preferred embodiment of the invention provides parallel flow of liquid through the finned tubing and the unfinned tubing. This assures a minimum temperature differential between the tubes. However, the liquid may flow in series through the tubes in some applications.

I claim:

1. A heat exchanger, comprising helical coil of tubing having circular fins; helical coil of smaller diameter bare tubing surrounding said first coil; each turn of said second coil contacting adjacent turns of said first coil; both coils manifolded at inlets and outlets.

2. A heat exchanger according to claim 1 including an orifice in the inlet manifold to restrict flow to the finned coil.

3. A fluid heater comprising:

a burner comprising a flameholder;

a first coil of finned tubing surrounding the flameholder and carrying fluid to be heated; and a second coil of tubing surrounding the first coil and in contact with fins of adjacent turns of the first coil, the second coil also carrying fluid to be heated.

4. A fluid heater as claimed in claim 3 wherein the tubing of the second coil is of substantially smaller diameter than the tubing of the first coil.

5. A fluid heater as claimed in claim 4 wherein fluid to be heated is directed into the first and second coils in parallel.

6. A fluid heater as claimed in claim 5 further comprising a flow restriction to restrict flow to the finned coil.

7. A fluid heater as claimed in claim 3 wherein the burner is a gas burner.

* * * * *